United States Patent [19]

Politzer et al.

[11] 4,423,663

[45] Jan. 3, 1984

[54] ARRANGEMENT FOR A MORTAR IN AN ARMORED VEHICLE

[75] Inventors: Anton Politzer, Lauf/Pegn.; Wilhelm Machmer, Nuremberg, both of Fed. Rep. of Germany

[73] Assignee: Firma Diehl, Nuremberg, Fed. Rep. of Germany

[21] Appl. No.: 849,520

[22] Filed: Oct. 31, 1977

[30] Foreign Application Priority Data

Nov. 5, 1976 [DE] Fed. Rep. of Germany ..... 2650622

[51] Int. Cl.[3] ..... F41H 7/08

[52] U.S. Cl. ..... 89/40 A; 89/41 R

[58] Field of Search ..... 89/36 H, 37 R, 37 C, 89/40 R, 40 A, 40 B, 41 R

[56] References Cited

U.S. PATENT DOCUMENTS 3,165,973 1/1965 Bohrmann ..... 89/40 A 3,818,794 6/1974 Mayer et al. ..... 89/40 A

FOREIGN PATENT DOCUMENTS 298874 6/1920 Fed. Rep. of Germany ..... 89/40 A

*Primary Examiner*—Bentley Stephen C.

*Attorney, Agent, or Firm*—Scully, Scott, Murphy and Presser

[57] ABSTRACT

Arrangement for a mortar in an armored vehicle having a gun laying device. A ball bearing support is provided for the mortar in a traverse on the vehicle and allows for the axial displacement of the mortar to facilitate breech-loading of munitions having different sizes while protecting the interior of the vehicle.

5 Claims, 5 Drawing Figures

ARRANGEMENT FOR A MORTAR IN AN ARMORED VEHICLE

BACKGROUND OF THE INVENTION

1. Field of the Invention

The present invention relates to an arrangement for a mortar in an armored vehicle with a gun laying device, and a ball bearing provided for the mortar, which is located in a vehicle traverse.

2. Discussion of the Prior Art

That type of arrangement has become known from German Published Patent Specification No. 15 78 047, wherein the mouth of the mortar is located within an opening of a rotatable protective shield adapted to be closed through the intermediary of two shutters. This opening allows the mortar to be loaded from the "front" end thereof. Disadvantageous is the lack of protection afforded the loading shelter which is unshielded during the loading sequence, and the unprotected interior of the vehicle due to the opening.

Furthermore, it has also become known from German Pat. No. 2,037,819 that, for universally directable guns built into gun turrets or armored vehicles there be provided an armored gun laying mechanism. The recoilingly constructed gun is hereby cardanically and non-rotatably suspended in the interior of the gun turret and supported in a rotatable hood or shield, which is supported in a second similarly rotatable annular shield. The rotational axes of the two shields form two telescopically rollable cones and whose common cone apices are located in cardan. That type of arrangement is not suited for mortars in view of the complex recoil mechanism, cardan support and the large volumetric spatial demands in the interior of the vehicle required by the extent of gun laying or range finding. Accordingly, it is an object of the present invention to avoid the drawbacks and disadvantages encountered in the prior art.

SUMMARY OF THE INVENTION

The advantages which are obtained through the present invention consist of in that the arrangement is constituted of only a few and simple components. Through additional, but relatively inexpensive sealing measures provided at the shutters it is possible to achieve protection for the interior of the vehicle not only against atomic, bacteriological and chemical effects, but it is also possible to obtain an improved stream crossing ability and, upon occasion, even submergability of the vehicle. Furthermore, it is advantageous that the shutters or hatches be dimensioned to a size which is merely required for armoring, since the recoil forces which are produced at firing are dissipated through the ball end of the gun mount towards a vehicle-mounted traverse. Thus, the shutters may be constructed relatively lightweight, which is particularly advantageous for speedy and maneuverable vehicles, such as armored cars. Finally, due to the variable extent of the slide path of the mortar along the gun mount, munition or projectiles having differing lengths can be loaded and fired.

BRIEF DESCRIPTION OF THE DRAWINGS

Reference may now be had to the detailed description of an exemplary embodiment of the invention, taken in conjunction with the accompanying drawings; in which.

DETAILED DESCRIPTION

Figure 1:
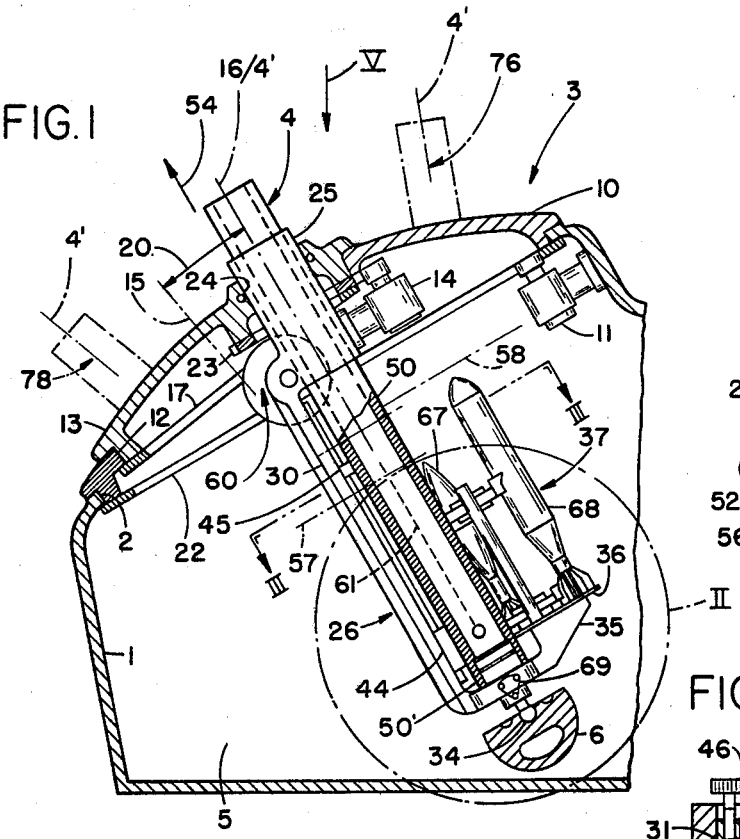
FIG. 1 illustrates a sectional view of a portion of a vehicle having a mortar supported in a gun laying or sighting installation.

An armored vehicle body shell 1, for example that of an armored car, includes an opening 2 for an armored gun laying device 3 as shown, for instance, in German Pat. No. 2,037,819. The gun laying or sighting device 3 is provided for a mortar 4, whose recoil is absorbed by a traverse 6 which is fastened to the side wall portions 5 (FIG. 5) of the vehicle body shell 1.

The gun laying device 3 consists of a curved annular shield 10 rotatably supported in the opening 2, which includes a gun laying controlling motor 11, and an inner shield 13 which is similarly rotatably mounted in an opening 12 in the annular shield 10, and which includes a further gun laying controlling motor 14. The gun laying controlling motor 11 is fastened to the vehicle body shell 1, whereas the gun laying controlling motor 14 is fastened to a tubular section 25.

Figure 2:
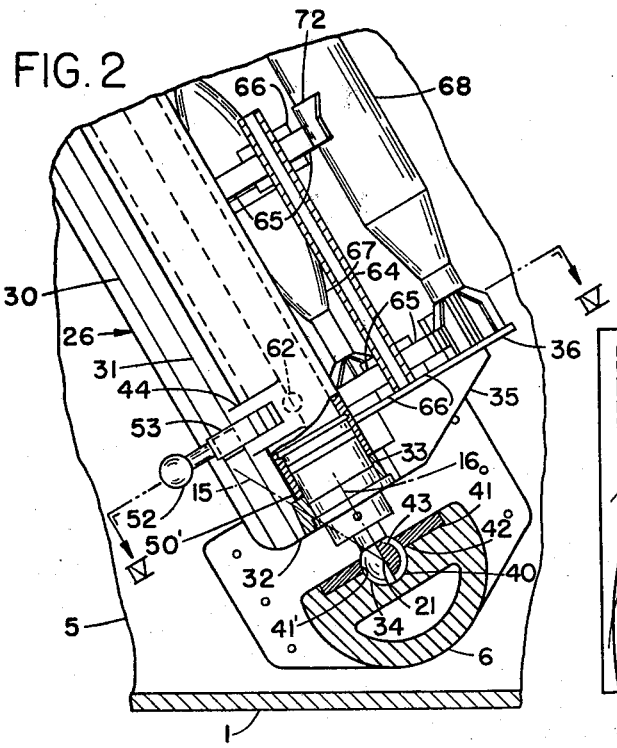
FIG. 2 is an enlarged section of the mortar shown in the encircled portion in FIG. 1.

The rotational axes 15, 16 of the above-mentioned shields 10, 13 subtend an angle 20 and, in the supported position 21 of the mortar 4, cut against the traverse 6 (FIG. 2). The gun laying controlling motors 11, 14 engage in gear rings 22, 23 which are connected with the shields 10, 13. These gear rings, respectively a ring 17, secure the shields 10, 13 in an axial direction.

The inner shield 13 possesses an opening 24 in which there is supported the tubular section 25 of a gun mount 26. The gun mount 26 is constituted of the previously mentioned tubular section 25, a stirrup 30 having a rail 31 threadedly fastened thereto (FIG. 3), a breech plate 32 with sealing cylinder 33, and a ball end or spherical head 34, and a carrying arm 35 with a plate 36 for the magazine 37 (FIG. 2). The spherical head 34 extends into a complementary shaped recess 40 formed in the traverse 6. Serving as the bearing lock is a plate 41 having a spherical recess 41', and provided as a lock against rotation is a pin 42 mounted on the traverse, which projects into a groove 43 formed in the spherical head 34. A known per se tension trigger 69 is screwed into the sealing cylinder 33 for effecting the percussion priming of the ammunition (FIG. 1).

The tube 50 of the mortar 4 is slidably connected with the gun mount 26 (FIG. 3) through the intermediary of a dovetail guide 27 and through the tubular section 25. The dovetail guide 27 consists of the previously mentioned rail 31 and a corresponding slot 51 formed in a reinforcement 44 in the side of the tube (FIG. 1). Furthermore, the tube 50 is provided with a lever 52 supported on the side of the tube at 55 (FIG. 4) for locking the tube 50 into its firing position through the intermediary of a locking dog 53 on the gun mount, and for the axial displacement of the tube 50 in the direction of arrow 54.

A weight-compensating or balancing device 60 for the tube 50, not described in detail, consists in a known manner, of a spring-force accumulator and a cable 61 which is fastened to a bolt 64 on the side of the tube.

Forming a stroke limiter for the tube 50 in the direction of arrow 54 is a stop 45 which is lockable on the guide rail 31 (FIG. 3) in conjunction with the dovetail guide 27 and a shift lock 46.

Figure 3:
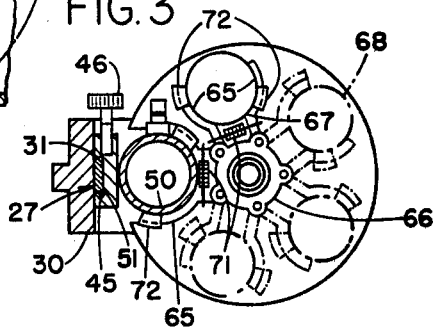
FIG. 3 is a sectional view taken along line III—III in FIG. 1.

Fastened on the carrying arm 35 is a five-shot drum magazine 37 (FIG. 2). The latter consists of a shaft 64 supported in the carrying arm 35 with grippers 65 at the head and foot ends for the munitions 67, 68. The grippers 65 are articulated with hubs 66 which are connected with the shaft 65, and provided with springs 71 (FIG. 3). Additionally, the grippers 65 evidence funnel-shaped deflector flanges 72.

Figure 4:
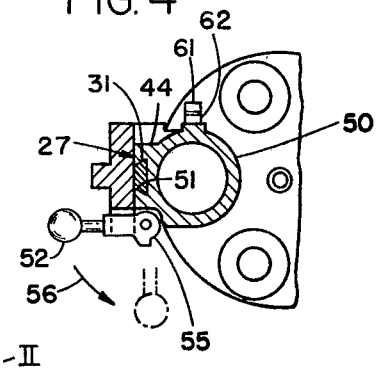
FIG. 4 is a sectional view taken along line IV—IV in FIG. 2.

For effectuating the loading of the mortar 4, the tube 50 must be unlocked by means of the lever 52 which is pivotable in the direction of arrow 56 (FIG. 4). Thereafter, the tube 50 must be displaced in the direction of arrow 54 (FIG. 1) in conformance with the length of the munition which is to be loaded. For loading the munition 67 the tube end 50' must be raised into the position 57, whereas for the munition 68 it must be raised into the position 58. The extent of displacement of the tube 50 must be limited by the currently adjusted stop 45.

The weight-compensation or balancing device 60 facilitates the ready stroke movement of the tube 50. Thereafter, the magazine is rotated by means of the shaft 64 in conformance with the desired munition into the loading position, so that the respective munition axis is in super-position with the bore axis 4' of the tube 50. Subsequently, the tube 50 is inverted over the munition whereby the tube end 50' forces the grippers 65 apart over the deflector flanges 72 in opposition to the force of the spring 71. Until the tube end 50' contacts the breech plate 32, the grippers 65 slide along the exterior of tube 50.

After the contacting of the tube 50 against the breech plate 32, there is effected the locking through the intermediary of lever 52, whereby the lever 52 is to be pressed against an inclined plane on the stop 53 at the side of the gun mount (not shown) so that the tube 50 lies biased against the breech plate 32 and is sealed by means of the sealing cylinder 33.

Through the suitable gun laying or direction finding by the gun laying controlling motors 11, 14, which are controlled by a suitable control system (not shown), there is determined the firing position of the mortar which may then be fired by the tension trigger 69.

The aiming or laying of the mortar 4 into the desired position is facilitated by the exterior gun laying cone 75 (FIG. 5) which is determined through the rotational axes 15, 16 and angle 20.

Figure 5:
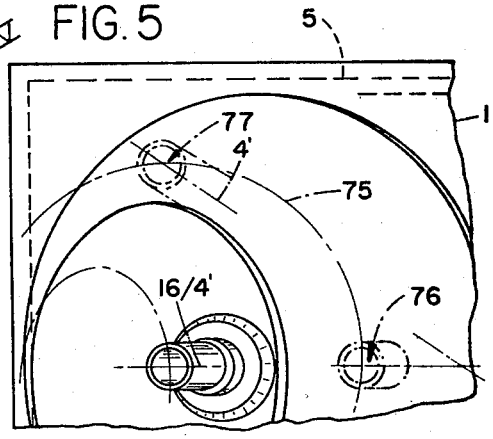
FIG. 5 is a view in the direction of arrow V in FIG. 1.

Illustrated in FIG. 5 in conformance with the phantom lines of the uppermost or steepest gun aiming or laying position 76 in FIG. 1, is this position 76 as well as the extremest sidewise position 77. A lowermost gun laying position 78 of the mortar 4 may be ascertained from FIG. 1.

After the firing of the munition, the above-described procedures may be repeated for the next shot.

In the event of failure of the motors 11, 14, suitable hand wheels may be utilized for the manual setting of the gun laying device 3.

I claim:

1. Arrangement for a mortar in an armored vehicle, including a gun laying device, and a ball bearing for said mortar located in a vehicle traverse; characterized by a gun mount, the tube of said mortar being axially displaceably supported in said gun mount, said gun mount including a spherical head fitted into said ball bearing in said traverse and a tubular section for axially guiding said mortar tube; a pair of armored shutters forming said gun laying device being rotatable relative to each other in said vehicle, and means on said mortar tube and said gun mount to facilitate displacement of said mortar tube on said gun mount along the direction of said tubular section for the breech-ended loading of munition and for locking into a firing position subsequent to loading of said mortar.

2. Arrangement as claimed in claim 1, comprising a groove being formed in said spherical head and extending in the direction of the bore axis of said mortar for non-rotatably supporting said gun mount in said traverse, a pin on said traverse extending into said groove, and a plate mounted on said traverse encompassing said spherical head and forming an axial fastening.

3. Arrangement as claimed in claim 1, said tubular section being supported in the inner shutter of said pair of armored shutters forming said gun laying device, a gear ring on said inner shutter concentrically encompassing said tubular section, and a gun laying controlling motor drive being mounted on said tubular section engaging into said gear ring.

4. Arrangement as claimed in claim 1, comprising a dovetail guide slidably connecting said gun mount with sid mortar tube, said means on said mortar tube including a reinforcement on said tube with a pivotably supported lever and a protection on said gun mount whereby, in the firing position, said lever presses and locks said mortar tube against the breech plate of said gun mount through the intermediary of said projection.

5. Arrangement as claimed in claim 1, comprising a sealing cylinder mounted on the breech plate of said gun mount for sealing said mortar tube.

* * * * *